US008304973B2

(12) United States Patent
Yamashita et al.

(10) Patent No.: US 8,304,973 B2
(45) Date of Patent: Nov. 6, 2012

(54) FLASH LAMP

(75) Inventors: Yuichi Yamashita, Hamamatsu (JP); Yusuke Hasegawa, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 17 days.

(21) Appl. No.: 12/861,284

(22) Filed: Aug. 23, 2010

(65) Prior Publication Data

US 2012/0043883 A1 Feb. 23, 2012

(51) Int. Cl.
*H01J 1/46* (2006.01)

(52) U.S. Cl. ..... 313/294; 313/296

(58) Field of Classification Search ..... 313/293–304, 313/581

See application file for complete search history.

(56) References Cited

U.S. PATENT DOCUMENTS

| | | | | |
|---|---|---|---|---|
| 2,977,508 | A | 7/1956 | Germeshausen | |
| 3,350,602 | A | 10/1967 | Germeshausen | |
| 3,356,888 | A | 12/1967 | Germeshausen | |
| 3,418,507 | A * | 12/1968 | Young | 313/18 |
| 3,911,375 | A * | 10/1975 | DeMaria et al. | 372/53 |
| 3,944,887 | A * | 3/1976 | Suzuki | 361/56 |
| 4,020,379 | A | 4/1977 | Manning | |
| 4,755,719 | A * | 7/1988 | Limpaecher | 313/597 |
| 5,128,596 | A | 7/1992 | Shimazu et al. | |
| 6,236,147 | B1 | 5/2001 | Capobianco | |
| 6,274,970 | B1 | 8/2001 | Capobianco | |
| 6,339,279 | B1 * | 1/2002 | Miyamoto et al. | 313/113 |
| 6,339,280 | B1 * | 1/2002 | Miyamoto et al. | 313/113 |
| 7,728,522 | B2 * | 6/2010 | Kang | 313/585 |
| 2002/0057043 | A1 * | 5/2002 | Miyamoto | 313/46 |
| 2003/0193281 | A1 * | 10/2003 | Manning | 313/113 |
| 2005/0258752 | A1 * | 11/2005 | Kang | 313/584 |
| 2006/0138960 | A1 * | 6/2006 | Derra et al. | 313/618 |

FOREIGN PATENT DOCUMENTS

| | | |
|---|---|---|
| JP | 31-1594 | 3/1956 |
| JP | 56-1746 | 1/1981 |
| JP | 2005-285468 | 10/2005 |

* cited by examiner

*Primary Examiner* — Bumsuk Won

(74) *Attorney, Agent, or Firm* — Drinker Biddle & Reath LLP

(57) ABSTRACT

In a flash lamp 1, a front end part 62 of a cathode 60 and a front end part 72 of an anode 70 are opposed to each other on a reference line RL, and with respect to a reference surface RS including the reference line RL, a front end part 82 of a trigger electrode 80 is located on one side, and a front end part 92 of a trigger electrode 90 is located on the other side. Further, a terminal end 82*a* of the front end part 82 of the trigger electrode 80 and a terminal end 92*a* of the front end part 92 of the trigger electrode 90 are separated from the reference line RL, and each front end part 82, 92 is formed so as to taper toward the reference line RL. Accordingly, an arc discharge occurs in a limited route R from a terminal end portion of the front end part 62 of the cathode 60 through a terminal end portion of the front end part 82 of the trigger electrode 80 and a terminal end portion of the front end part 92 of the trigger electrode 90 to a terminal end portion of the front end part 72 of the anode 70.

5 Claims, 7 Drawing Sheets

FLASH LAMP

BACKGROUND OF THE INVENTION

1. Field of the Invention

The present invention relates to a flash lamp.

2. Related Background Art

As a conventional flash lamp, one including a hermetically sealed container filled with a discharge gas, a cathode and an anode for generating an arc discharge in the hermetically sealed container, and a plurality of trigger electrodes for generating a preliminary discharge in the hermetically sealed container has been known (refer to, for example, Japanese Examined Patent Application Publication No. S56-001746 and specification of U.S. Pat. No. 3,356,888). In such a flash lamp, when a trigger voltage is applied to the trigger electrodes with a predetermined voltage applied between the cathode and anode, a preliminary discharge is first generated by the trigger electrodes, and then, an arc discharge is generated by the cathode and anode. Accordingly, when a pulse voltage is applied as the trigger voltage to the trigger electrodes, an arc discharge is generated in a pulsed manner, and consequently, the flash lamp performs pulsed emission.

SUMMARY OF THE INVENTION

The flash lamp as described above is used as a light source of a spectrometer, an optical emission spectrometer, or the like, and in such a case, a light emission of the flash lamp is often clipped by an aperture or the like placed at a predetermined position relative to the flash lamp. Therefore, when an arc discharge fluctuates, an optical output clipped by the aperture or the like varies from one pulsed emission to another.

It is therefore an object of the present invention to provide a flash lamp that can suppress the occurrence of fluctuations in arc discharge.

In order to achieve the above-mentioned object, a flash lamp of the present invention includes: a hermetically sealed container filled with a discharge gas; a cathode and an anode for generating an arc discharge, arranged in the hermetically sealed container; and a first trigger electrode and a second trigger electrode for generating a preliminary discharge prior to the arc discharge, arranged in the hermetically sealed container, and in which a front end part of the cathode and a front end part of the anode are opposed to each other on a predetermined reference line, a front end part of the first trigger electrode is located closer to the cathode than a front end part of the second trigger electrode in a direction parallel to the reference line, the front end part of the first trigger electrode is formed on one side of a predetermined reference surface including the reference line, so as to taper toward to the reference line such that a terminal end thereof is separated from the reference line, and the front end part of the second trigger electrode is formed on the other side of the reference surface, so as to taper toward the reference line such that a terminal end thereof is separated from the reference line.

In this flash lamp, the front end part of the cathode and the front end part of the anode are opposed to each other on a reference line, and with respect to a reference surface including the reference line, the front end part of the first trigger electrode is located on one side, and the front end part of the second trigger electrode is located on the other side. Further, the terminal end of the front end part of the first trigger electrode and the terminal end of the front end part of the second trigger electrode are separated from the reference line, and the front end part of the first trigger electrode and the front end part of the second trigger electrode are formed so as to taper as they near the reference line. Accordingly, an arc discharge stably occurs in a limited route from a terminal end portion (the terminal end and its neighboring part) of the front end part of the cathode through a terminal end portion of the front end part of the first trigger electrode and a terminal end portion of the front end part of the second trigger electrode to a terminal end portion of the front end part of the anode. Therefore, by this flash lamp, the occurrence of fluctuations in arc discharge can be suppressed.

Here, it is preferable that a starting end of the front end part of the first trigger electrode and a starting end of the front end part of the second trigger electrode are located outside of the cathode and the anode when viewed from the direction parallel to the reference line. By this configuration, it becomes still more difficult for an arc discharge to flow through a starting end portion (the starting end and its neighboring part) of the front end part of the first trigger electrode and a starting end portion of the front end part of the second trigger electrode, and thus the occurrence of fluctuations in arc discharge can be suppressed more reliably.

Moreover, it is preferable that the cathode has an opposed cathode discharge surface from which electrons are emitted in the front end part of the cathode, the anode has an opposed anode discharge surface into which electrons are absorbed in the front end part of the anode, and the terminal end of the front end part of the first trigger electrode and the terminal end of the front end part of the second trigger electrode are located outside of the opposed cathode discharge surface and the opposed anode discharge surface when viewed from the direction parallel to the reference line. By this configuration, it becomes still easier for an arc discharge to flow through the terminal end portion of the front end part of the first trigger electrode and the terminal end portion of the front end part of the second trigger electrode, and thus the occurrence of fluctuations in arc discharge can be suppressed more reliably.

DESCRIPTION OF THE PREFERRED EMBODIMENTS

Figure 1:
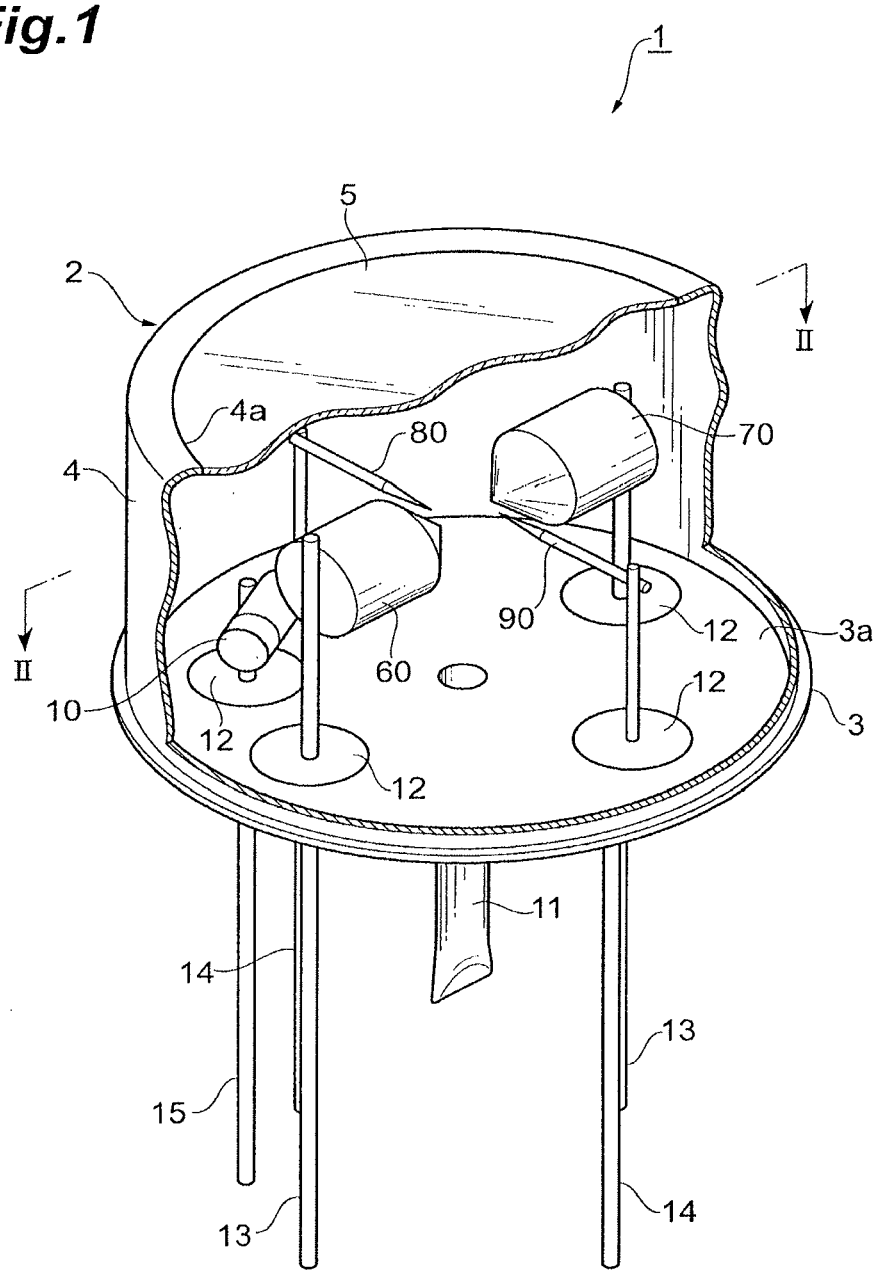
FIG. 1 is a partially cut-away perspective view of a flash lamp according to an embodiment of the present invention.

Hereinafter, preferred embodiments of the present invention will be described in detail with reference to the drawings. Also, the same or corresponding parts are denoted with the same reference numerals in the drawings, and overlapping description will be omitted.

As shown in FIG. 1, a flash lamp 1 includes a hermetically sealed container 2 filled with xenon gas (a discharge gas). The hermetically sealed container 2 has a disk-shaped stem 3 made of metal, a cylindrical cap 4 made of metal, and a disk-shaped light transmission window 5 made of glass. The light transmission window 5 blocks an opening 4*a* that is circular in section provided in the cap 4 at a position opposed to an inner surface 3*a* of the stem 3. Also, in the stem 3, a sealing tube 11 to be sealed after filling xenon gas into the hermetically sealed container 2 is provided.

In the hermetically sealed container 2, a cathode 60 and an anode 70 for generating an arc discharge and a trigger electrode (first trigger electrode) 80 and a trigger electrode (second trigger electrode) 90 for generating a preliminary discharge prior to the arc discharge, and a sparker electrode 10 for stably generating an arc discharge are arranged. The cathode 60 and the anode 70 are each fixed to an end portion of a lead pin 13 penetrating through the stem 3 via an insulating member 12. The trigger electrodes 80, 90 are each fixed to an end portion of a lead pin 14 penetrating through the stem 3 via the insulating member 12. The sparker electrode 10 is fixed to an end portion of a lead pin 15 penetrating through the stem 3 via the insulating member 12.

Figure 2:
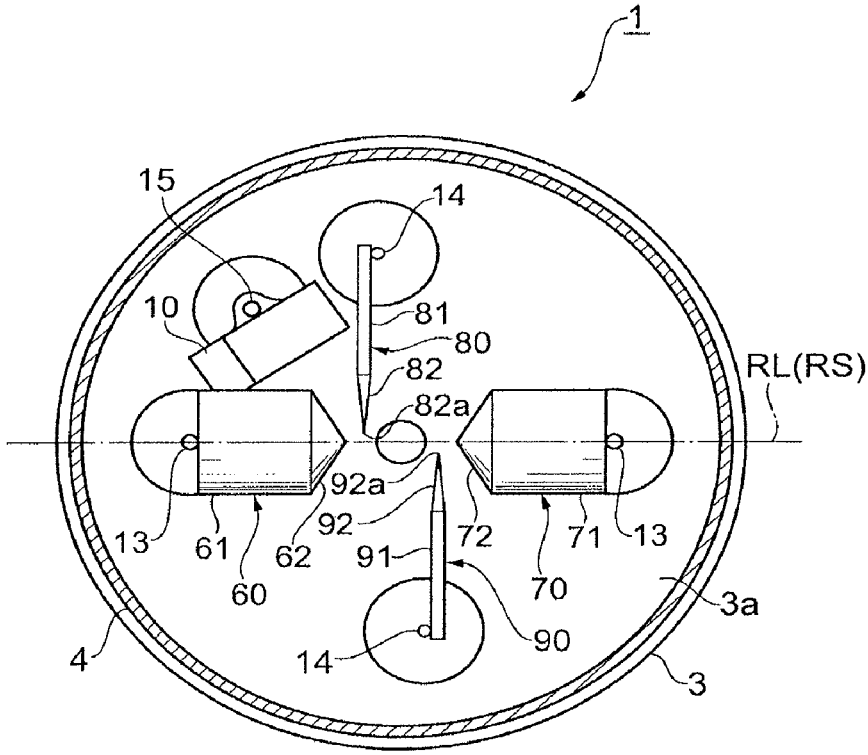
FIG. 2 is a sectional view of the flash lamp taken along a line II-II of FIG. 1.

As shown in FIG. 2, the cathode 60 has a columnar body part 61 forming a base end part to which the end portion of the lead pin 13 is fixed, and a conical front end part 62 that tapers with increasing distance from the body part 61. The body part 61 and the front end part 62 are made of, for example, tungsten, and formed as one body around the same straight line used as a centerline. Similarly, the anode 70 has a columnar body part 71 forming a base end part to which the end portion of the lead pin 13 is fixed, and a conical front end part 72 that tapers with increasing distance from the body part 71. The body part 71 and the front end part 72 are made of, for example, tungsten, and formed as one body around the same straight line used as a centerline.

The cathode 60 and the anode 70 are arranged so that their respective centerlines (that is, a line connecting apices of the conical front end parts 62, 72 to each other) are almost coincident with a reference line RL. The front end part 62 of the cathode 60 and the front end part 72 of the anode 70 are opposed to each other on the reference line RL (that is, facing each other head on). In addition, the reference line (predetermined reference line) RL is a straight line substantially parallel to the inner surface 3*a* of the stem 3.

The trigger electrode 80 has a columnar pin-shaped body part 81 forming a base end part to which the end portion of the lead pin 14 is fixed, and a conical pin-shaped front end part 82 that tapers with increasing distance from the body part 81. The body part 81 and the front end part 82 are made of, for example, molybdenum, and formed as one body around the same straight line used as a centerline. Similarly, the trigger electrode 90 has a columnar pin-shaped body part 91 forming a base end part to which the end portion of the lead pin 14 is fixed, and a conical pin-shaped front end part 92 that tapers with increasing distance from the body part 91. The body part 91 and the front end part 92 are made of, for example, molybdenum, and formed as one body around the same straight line used as a centerline.

The front end part 82 of the trigger electrode 80 is located closer to the cathode 60 than the front end part 92 of the trigger electrode 90 in a direction parallel to the reference line RL. The front end part 82 of the trigger electrode 80 is formed on one side of a reference surface RS, so as to have a pointed shape tapering toward the reference RL such that a terminal end (that is, a front end) 82*a* of the front end part 82 is separated from the reference line RL. On the other hand, the front end part 92 of the trigger electrode 90 is formed on the other side of the reference surface RS, so as to have a pointed shape tapering toward the reference RL such that a terminal end 92*a* of the front end part 92 is separated from the reference line RL. In addition, the reference surface (predetermined reference surface) RS is a surface including the reference line RL, and is here a plane substantially vertical to the inner surface 3*a* of the stem 3. Moreover, the trigger electrodes 80, 90 are arranged here so that their respective centerlines become substantially vertical to the reference surface RS, and so as to be located on the same plane including the reference line RL and substantially vertical to the reference surface RS.

Figure 3:
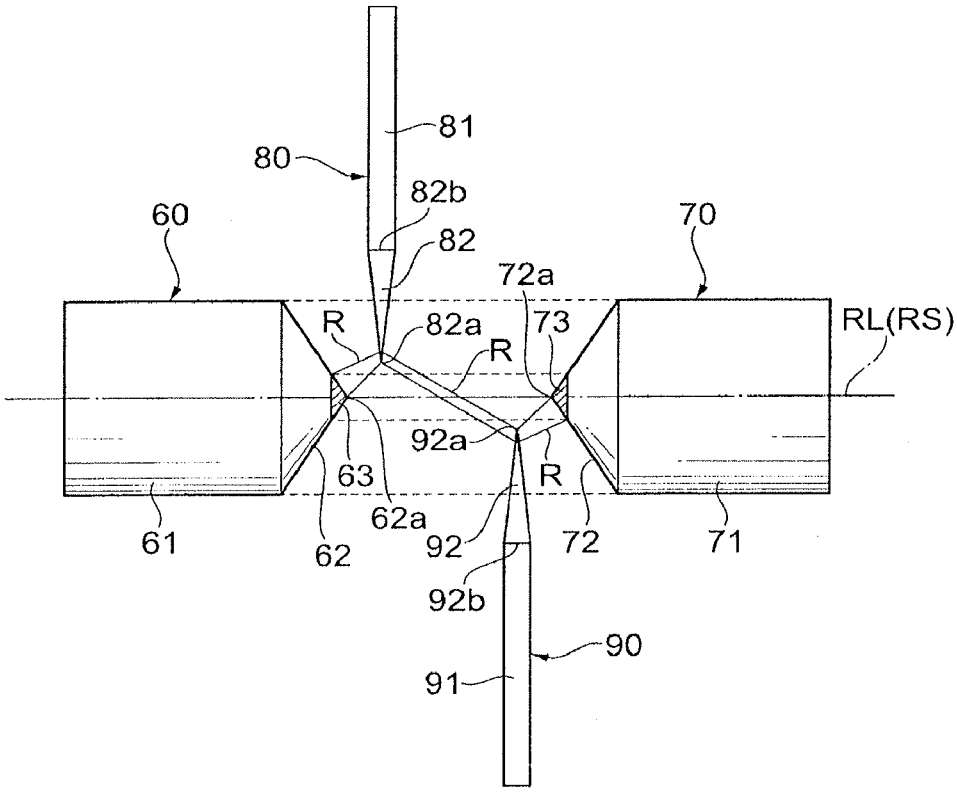
FIG. 3 is enlarged views of a front end portion of a cathode of FIG. 1.

As shown in FIG. 3, a starting end (that is, a base end) 82*b* of the front end part 82 of the trigger electrode 80 and a starting end 92*b* of the front end part 92 of the trigger electrode 90 are located outside of the cathode 60 and the anode 70 when viewed from the direction parallel to the reference line RL. That is, the starting ends 82*b*, 92*b* are located outside of a cylindrical space demarcated by a bottom surface of the front end part 62 of the cathode 60, a bottom surface of the front end part 72 of the anode 70, and a surface formed by a straight generatrix that connects peripheral lines of the both of the bottom surfaces to each other.

The terminal end 82*a* of the front end part 82 of the trigger electrode 80 and the terminal end 92*a* of the front end part 92 of the trigger electrode 90 are located outside of an opposed cathode discharge surface 63 included in the cathode 60 and an opposed anode discharge surface 73 included in the anode 70 when viewed from the direction parallel to the reference line RL. That is, the terminal ends 82*a*, 92*a* are located outside of a cylindrical space demarcated by the opposed cathode discharge surface 63, the opposed anode discharge surface 73, and a surface formed by a straight generatrix that connects peripheral lines of the both of the opposed discharge surfaces 63 and 73 to each other. In addition, the terminal ends 82*a*, 92*a* are, when viewed from the direction parallel to the reference line RL, located inside of the cathode 60 and the anode 70 (preferably, within a range, from the reference line RL, up to ¼ of a distance between the terminal end 62*a* of the cathode 60 and the terminal end 72*a* of the anode 70 (discharge electrode distance)).

Figure 4:
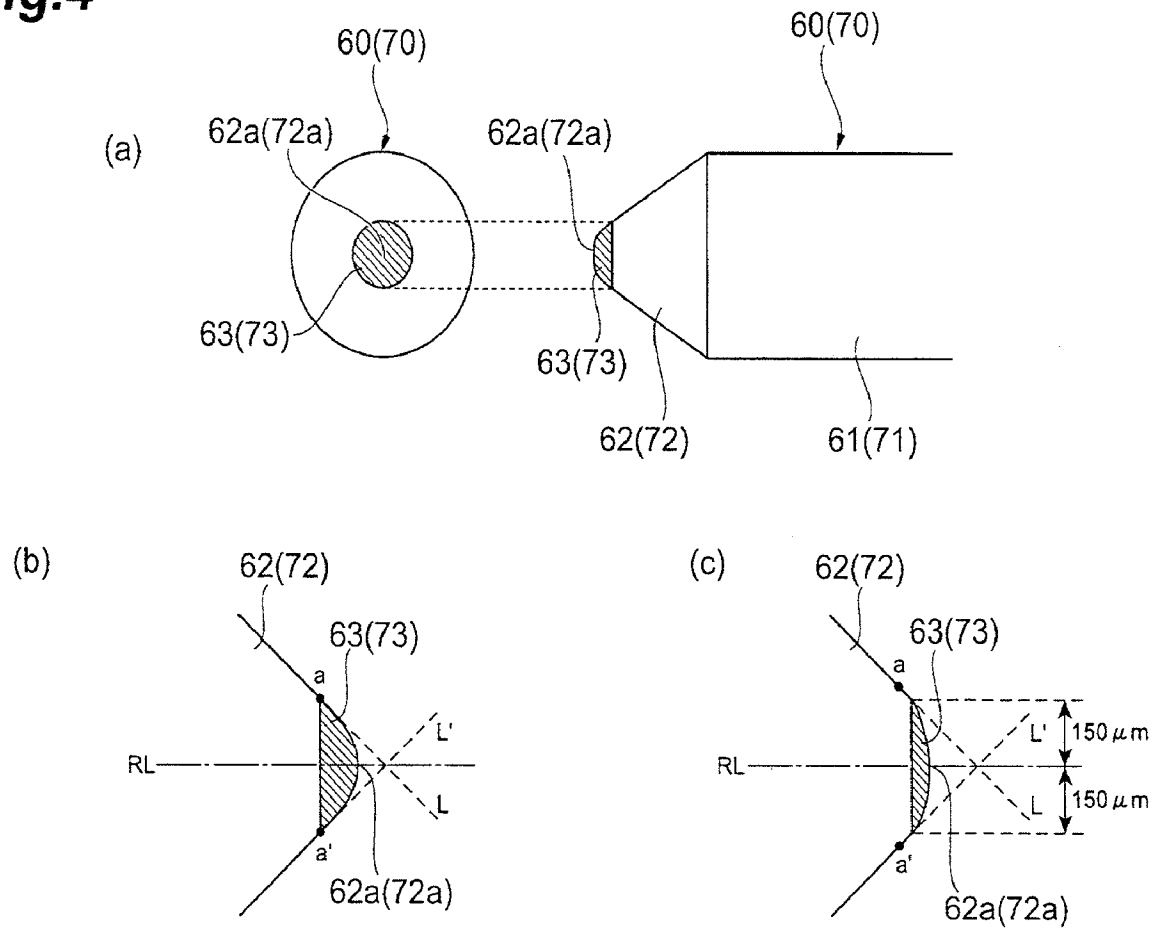
FIG. 4 is a plan view of a part including a cathode and an anode and trigger electrodes of FIG. 1.

Here, the opposed cathode discharge surface 63 is a surface from which electrons are emitted in the front end part 62 of the cathode 60, and the opposed anode discharge surface 73 is a surface into which electrons are absorbed in the front end part 72 of the anode 70. In greater detail, as shown in FIGS. 4(*a*) and (*b*), the opposed cathode discharge surface 63 corresponds to a part (shaded area in FIG. 4), in the front end part 62 of the cathode 60, closer to the terminal end 62*a* than a point of contact a, a' of a tangent L, L' along the shape of the front end part 62. Similarly, the opposed anode discharge surface 73 corresponds to a part (shaded area in FIG. 4), in the front end part 72 of the anode 70, closer to the terminal end 72*a* than a point of contact a, a' of a tangent L, L' along the shape of the front end part 72.

However, because of the current density of discharge, the opposed cathode discharge surface 63 and opposed anode discharge surface 73 are in a range up to 150 μm from the electrode center. Therefore, as shown in FIG. 4(*c*), when the point of contact a, a' is separated by 150 μm or more from the terminal end 62*a* being an electrode center, the opposed cathode discharge surface 63 results in a part within 150 μm from the terminal end 62*a*. Similarly, when the point of contact a, a' is separated by 150 μm or more from the terminal end 72*a* being an electrode center, the opposed anode discharge surface 73 results in a part within 150 μm from the terminal end 72*a*.

Operation of the flash lamp 1 configured as above will be described. First, a predetermined voltage is applied between the cathode 60 and the anode 70 by a main power supply section electrically connected to the lead pin 13. In this state, a pulse voltage is applied to the sparker electrode 10 and the trigger electrodes 80, 90 by a trigger power supply section electrically connected to the lead pins 13, 14.

As a result of such voltage application, the following phenomenon occurs in a pulsed manner. First, a preliminary discharge occurs in the sparker electrode 10, and ultraviolet rays are radiated. As a result of this ultraviolet radiation, photoelectrons are discharged from the cathode 60 and the trigger electrodes 80, 90, and the xenon gas in the hermetically sealed container 2 is ionized. When the preliminary discharge by the sparker electrode 10 ends, as shown in FIG. 3, a preliminary discharge occurs in a route R from a terminal end portion (the terminal end 62*a* and its neighboring part) of the front end part 62 of the cathode 60 through a terminal end portion (the terminal end 82*a* and its neighboring part) of the front end part 82 of the trigger electrode 80 and a terminal end portion (the terminal end 92*a* and its neighboring part) of the front end part 92 of the trigger electrode 90 to a terminal end portion (the terminal end 72*a* and its neighboring part) of the front end part 72 of the anode 70, and then, an arc discharge occurs in the same route R. Accordingly, the flash lamp 1 emits white light in a pulsed manner.

As described in the above, in the flash lamp 1, the front end part 62 of the cathode 60 and the front end part 72 of the anode 70 are opposed to each other on the reference line RL, and with respect to the reference surface RS including the reference line RL, the front end part 82 of the trigger electrode 80 is located on one side, and the front end part 92 of the trigger electrode 90 is located on the other side. Further, the terminal end 82*a* of the front end part 82 of the trigger electrode 80 and the terminal end 92*a* of the front end part 92 of the trigger electrode 90 are separated from the reference line RL, and each front end part 82, 92 is formed so as to taper as it nears the reference line RL. Accordingly, an arc discharge stably occurs in the route R formed in a limited region from the terminal end portion of the front end part 62 of the cathode 60 through the terminal end portion of the front end part 82 of the trigger electrode 80 and the terminal end portion of the front end part 92 of the trigger electrode 90 to the terminal end portion of the front end part 72 of the anode 70. Therefore, by the flash lamp 1, the occurrence of fluctuations in arc discharge can be suppressed. Consequently, when a light emission of the flash lamp 1 is clipped by an aperture placed at a predetermined position (here, a position corresponding to a central part of the light transmission window 5) with respect to the flash lamp 1, an optical output clipped by the aperture is stabilized.

Moreover, the starting end 82*b* of the front end part 82 of the trigger electrode 80 and the starting end 92*b* of the front end part 92 of the trigger electrode 90 are located outside of the cathode 60 and the anode 70 when viewed from the direction parallel to the reference line RL. This configuration makes it difficult for an arc discharge to flow through a starting end portion (the starting end 82*b* and its neighboring part) of the front end part 82 of the trigger electrode 80 and a starting end portion (the starting end 92*b* and its neighboring part) of the front end part 92 of the trigger electrode 90 serving as edges in the respective trigger electrodes 80, 90. Therefore, also by this configuration, the occurrence of fluctuations in arc discharge is suppressed.

Moreover, the terminal end 82*a* of the front end part 82 of the trigger electrode 80 and the terminal end 92*a* of the front end part 92 of the trigger electrode 90 are located outside of the opposed cathode discharge surface 63 included in the cathode 60 and the opposed anode discharge surface 73 included in the anode 70 when viewed from the direction parallel to the reference line RL. This configuration makes it easy for an arc discharge to flow through the terminal end portion of the front end part 82 of the trigger electrode 80 and the terminal end portion of the front end part 92 of the trigger electrode 90, as compared to when the terminal ends 82*a*, 92*a* are located inside of the opposed cathode discharge surface 63 and the opposed anode discharge surface 73. Therefore, also by this configuration, the occurrence of fluctuations in arc discharge is suppressed.

Next, examples of the respective dimensions in the flash lamp 1 will be described. First, the diameter of the body part 61, 71 of the discharge electrode (that is, the cathode 60 and the anode 70) (discharge electrode diameter) is 2.4 mm, and the distance between the terminal end 62*a* of the cathode 60 and the terminal end 72*a* of the anode 70 (discharge electrode distance) is 1.5 mm. That is, the terminal end 82*a* of the trigger electrode 80 and the terminal end 92*a* of the trigger electrode 90 are arranged within a range of the discharge electrode distance smaller than the discharge electrode diameter. Also, the diameter of the opposed cathode discharge surface 63 and the opposed anode discharge surface 73 is 200 μm.

Moreover, the diameter of the body part 81, 91 of the trigger electrode 80, 90 (trigger electrode diameter) is 0.4 mm, and in the direction parallel to the reference line RL, the distance between the terminal end 82*a* of the trigger electrode 80 and the terminal end 92*a* of the trigger electrode 90 (trigger electrode distance) is 0.4 mm to 0.7 mm. Thus, by providing the trigger electrode distance greater than the trigger electrode diameter, fluctuations in arc discharge to other than a route (a part of the route R) from the terminal end portion of the front end part 82 of the trigger electrode 80 to the terminal end portion of the front end part 92 of the trigger electrode 90 can be suppressed. Also, in the direction parallel to the reference line RL, the distance between the terminal end 62*a* of the cathode 60 and the terminal end 82*a* of the trigger electrode 80 is 0.3 mm to 0.5 mm.

Further, the distance between the reference line RL and the terminal end 82*a*, 92*a* of each trigger electrode 80, 90 is 0.2 mm to 0.3 mm. Thus, by providing the distance between the reference line RL and the terminal end 82*a*, 92*a* of each trigger electrode 80, 90 greater than ½ of the trigger electrode diameter, fluctuations in arc discharge to other than a route (a part of the route R) from the terminal end portion of the front end part 82 of the trigger electrode 80 to the terminal end portion of the front end part 92 of the trigger electrode 90 can be suppressed.

Figure 5:
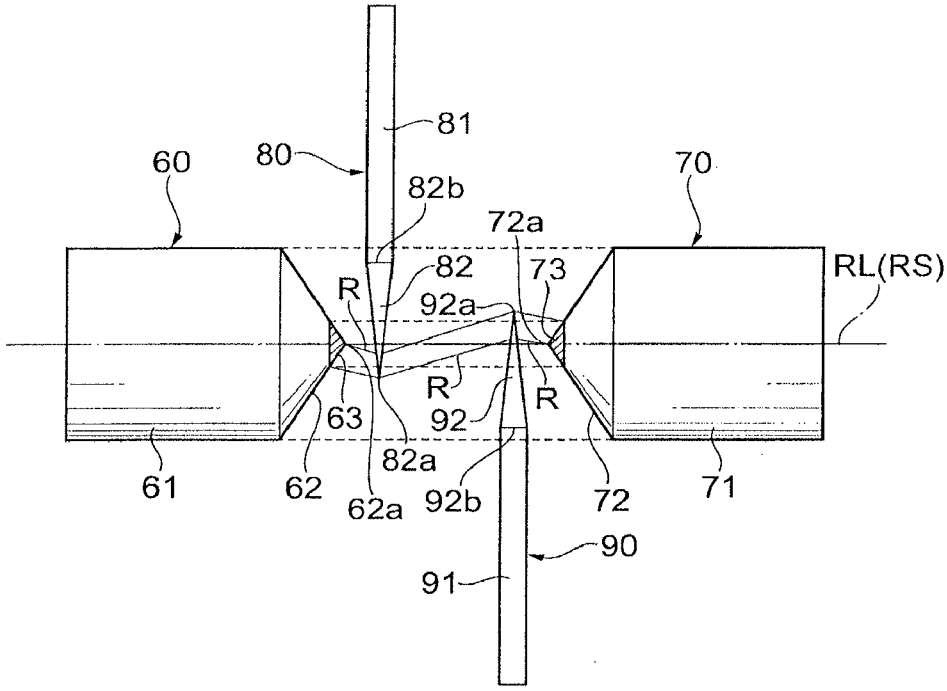
FIG. 5 is a plan view of a part including a cathode and an anode and trigger electrodes of comparative example 1.

Next, a flash lamp of a comparative example will be described. FIG. 5 is a plan view of a part including a cathode and an anode and trigger electrodes of comparative example 1. As shown in FIG. 5, the flash lamp of comparative example 1 is different from the foregoing flash lamp 1 in that the front end part 82 of the trigger electrode 80 and the front end part 92 of the trigger electrode 90 cross the reference line RL and the reference surface RS. Due to this difference, the distance between the terminal end 62*a* of the cathode 60 and the front end part 82 of the trigger electrode 80, the distance between the front end part 82 of the trigger electrode 80 and the front end part 92 of the trigger electrode 90, and the distance between the front end part 92 of the trigger electrode 90 and the terminal end 72*a* of the anode 70 results in smaller than those of the flash lamp 1. Therefore, in the flash lamp of comparative example 1, the route R where an arc discharge can occur is wider than that of the flash lamp 1.

Moreover, in the flash lamp of comparative example 1, the starting end 82*b* of the front end part 82 of the trigger electrode 80 and the starting end 92*b* of the front end part 92 of the trigger electrode 90 are, when viewed from a direction parallel to the reference line RL, located inside of the cathode 60 and the anode 70. Therefore, in the flash lamp of comparative example 1, as compared to the flash lamp 1 where the starting ends 82*b*, 92*b* are located outside of the cathode 60 and the anode 70, an arc discharge easily flows through the starting end portion of the front end part 82 of the trigger electrode 80 and the starting end portion of the front end part 92 of the trigger electrode 90 serving as edges in the respective trigger electrodes 80, 90.

Figure 6:
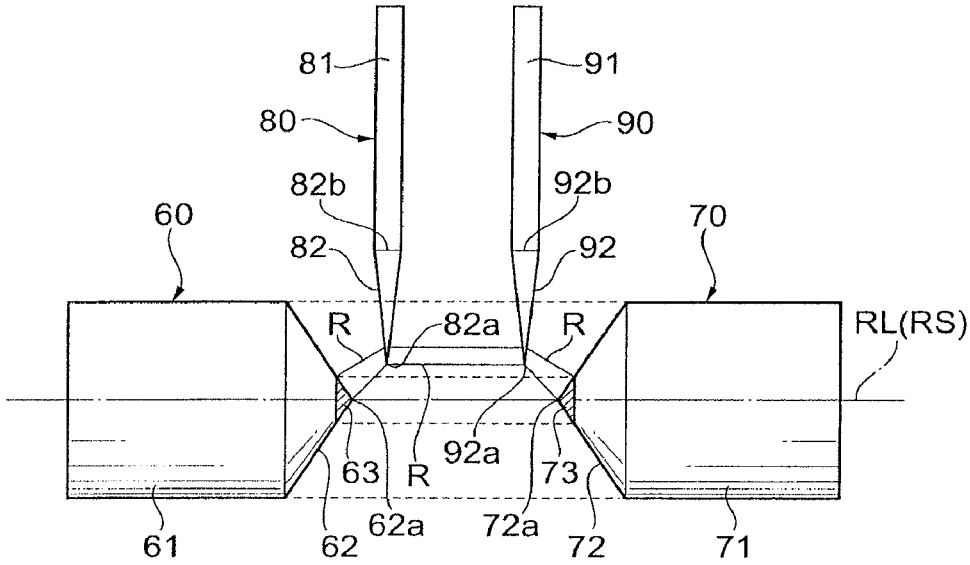
FIG. 6 is a plan view of a part including a cathode and an anode and trigger electrodes of comparative example 2.

FIG. 6 is a plan view of a part including a cathode and an anode and trigger electrodes of comparative example 2. As shown in FIG. 6, the flash lamp of comparative example 2 is different from the foregoing flash lamp 1 in that the front end part 82 of the trigger electrode 80 and the front end part 92 of the trigger electrode 90 are located on one side of the reference surface RS. Due to this difference, the distance between the front end part 82 of the trigger electrode 80 and the front end part 92 of the trigger electrode 90 results in smaller than that of the flash lamp 1. Therefore, in the flash lamp of comparative example 2, out of the route R where an arc discharge can occur, a route from the terminal end portion of the front end part 82 of the trigger electrode 80 to the terminal end portion of the front end part 92 of the trigger electrode 90 is wider than that of the flash lamp 1.

Figure 7:
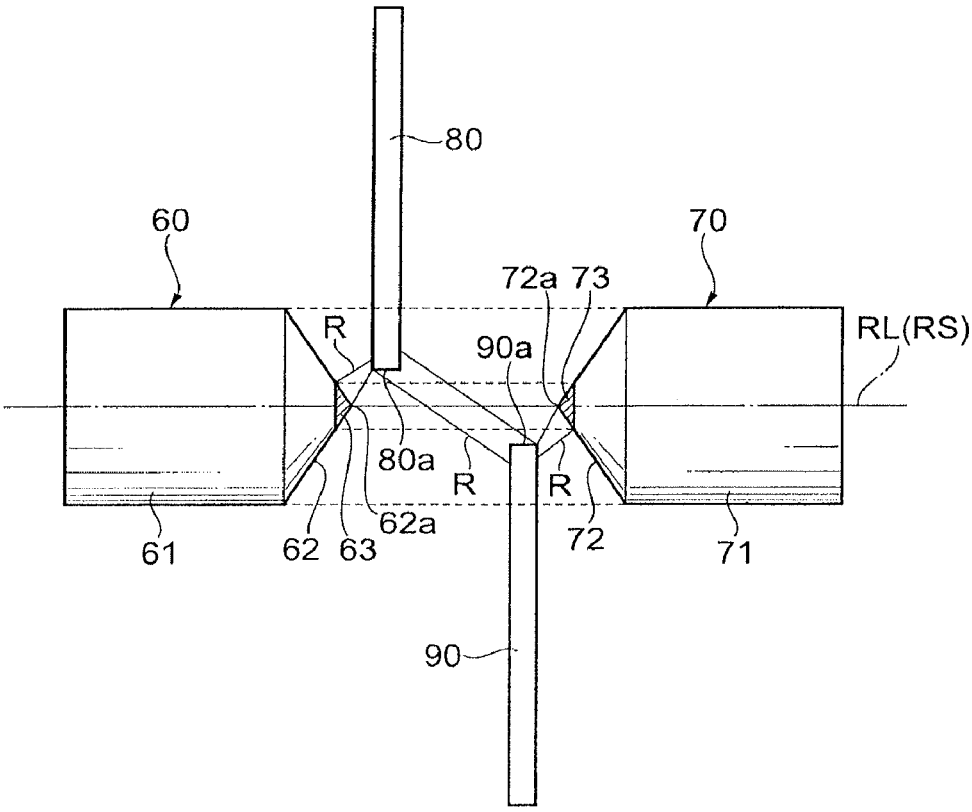
FIG. 7 is a plan view of a part including a cathode and an anode and trigger electrodes of comparative example 3.

FIG. 7 is a plan view of a part including a cathode and an anode and trigger electrodes of comparative example 3. As shown in FIG. 7, the flash lamp of comparative example 3 is different from the foregoing flash lamp 1 in that the trigger electrode 80, 90 does not have the tapering front end part 82, 92, and the trigger electrode 80, 90 as a whole is formed in a columnar pin shape. Due to this difference, each trigger electrode 80, 90 has a surface at its terminal end 80*a*, 90*a*. Therefore, in the flash lamp of comparative example 3, the route R where an arc discharge can occur is wider than that of the flash lamp 1.

In the above, an embodiment of the present invention has been described, however, the present invention is not limited to the above embodiment. For example, as long as a region including, out of the route R where an arc discharge can occur, a center portion in the direction parallel to the reference line RL is formed by the trigger electrode 80 and the trigger electrode 90, another trigger electrode may further be provided between the cathode 60 and the trigger electrode 80, and between the anode 70 and the trigger electrode 90. Moreover, the trigger electrodes 80, 90 may be arranged, with respect to, for example, a plane substantially parallel with the reference line RL and substantially vertical to the reference surface RS, on different sides from each other.

According to the preset invention, the occurrence of fluctuations in arc discharge can be suppressed.

What is claimed is:

1. A flash lamp comprising:

a hermetically sealed container filled with a discharge gas;

a cathode and an anode for generating an arc discharge, arranged in the hermetically sealed container; and a first trigger electrode and a second trigger electrode for generating a preliminary discharge prior to the arc discharge, arranged in the hermetically sealed container, wherein a front end part of the cathode and a front end part of the anode are opposed to each other on a predetermined reference line, a front end part of the first trigger electrode is located closer to the cathode than a front end part of the second trigger electrode in a direction parallel to the reference line, the front end part of the first trigger electrode is formed on one side of a predetermined reference surface including the reference line, so as to have a pointed shape tapering toward the reference line such that a terminal end thereof is separated from the reference line, and the front end part of the second trigger electrode is formed on the other side of the reference surface, so as to have a pointed shape tapering toward the reference line such that a terminal end thereof is separated from the reference line, and a hypothetical line connecting the terminal end of the front end part of the first trigger electrode and the terminal end of the front end part of the second trigger electrode crosses the reference surface at an oblique angle.

2. The flash lamp according to claim 1, wherein a starting end of the front end part of the first trigger electrode and a starting end of the front end part of the second trigger electrode are located outside of the cathode and the anode when viewed from the direction parallel to the reference line.

3. The flash lamp according to claim 1, wherein the cathode has an opposed cathode discharge surface from which electrons are emitted in the front end part of the cathode, the anode has an opposed anode discharge surface into which electrons are absorbed in the front end part of the anode, and the terminal end of the front end part of the first trigger electrode and the terminal end of the front end part of the second trigger electrode are located outside of the opposed cathode discharge surface and the opposed anode discharge surface when viewed from the direction parallel to the reference line.

4. The flash lamp according to claim 1, wherein longitudinal axes of the first trigger electrode and the second trigger electrode are arranged to be in parallel with each other.

5. The flash lamp according to claim 1, wherein a crossing point of the hypothetical line with the reference surface lies between the cathode and the anode.

* * * * *